US011283210B2

(12) United States Patent
Fuchs et al.

(10) Patent No.: US 11,283,210 B2
(45) Date of Patent: Mar. 22, 2022

(54) ELECTRICAL PLUG-IN CONNECTOR, INSULATING PROTECTIVE ELEMENT AND METHOD FOR ASSEMBLING AN ELECTRICAL PLUG-IN CONNECTOR

(71) Applicant: Rosenberger Hochfrequenztechnik GmbH & Co. KG, Fridolfing (DE)

(72) Inventors: Julian Fuchs, Traunstein (DE); Elie Truc-Vallet, Truanstein (DE); Markus Wallner, Saaldorf-Surheim (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 16/896,422

(22) Filed: Jun. 9, 2020

(65) Prior Publication Data

US 2021/0021074 A1 Jan. 21, 2021

(30) Foreign Application Priority Data

Jul. 16, 2019 (EP) ..... 19186433

(51) Int. Cl.
*H01R 13/514* (2006.01)
*H01R 13/436* (2006.01)
(Continued)

(52) U.S. Cl.
CPC ..... *H01R 13/436* (2013.01); *H01R 4/305* (2013.01); *H01R 13/6592* (2013.01);
(Continued)

(58) Field of Classification Search
CPC .. H01R 13/6592; H01R 4/305; H01R 13/436; H01R 31/06; H01R 43/20; H01R 2103/00
(Continued)

(56) References Cited

U.S. PATENT DOCUMENTS 3,976,352 A * 8/1976 Spinner ..... H01R 24/40 439/140
4,258,973 A * 3/1981 Reynolds ..... H01F 5/04 439/391
(Continued)

FOREIGN PATENT DOCUMENTS

DE 20 2010 009 598 U1 6/2010
EP 0 665 608 A2 12/1994
GB 2 299 900 A 4/1995

*Primary Examiner* — Abdullah A Riyami
*Assistant Examiner* — Vladimir Imas
(74) *Attorney, Agent, or Firm* — Donald S. Showalter, Esq.; GrayRobinson, P.A.

(57) ABSTRACT

An electrical plug-in connector includes an internal conductor contact element, an external conductor contact element and an insulating protective element arranged between the internal conductor contact element and the external conductor contact element. The external conductor contact element may have a recess for providing an assembly access point for fastening the internal conductor contact element to an internal conductor of an electrical cable. The insulating protective element can be displaced between an assembly position, in which the assembly access point is cleared through the assembly recess to the internal conductor contact element, and an insulating protection position, in which the assembly access point to the internal conductor contact element is blocked by the insulating protective element.

20 Claims, 8 Drawing Sheets

(51) Int. Cl.

| | |
|---|---|
| ***H01R 4/30*** | (2006.01) |
| ***H01R 13/6592*** | (2011.01) |
| ***H01R 31/06*** | (2006.01) |
| ***H01R 43/20*** | (2006.01) |
| *H01R 103/00* | (2006.01) |

(52) U.S. Cl.
CPC ..... *H01R 31/06* (2013.01); *H01R 43/20* (2013.01); *H01R 2103/00* (2013.01)

(58) Field of Classification Search
USPC ..... 439/752
See application file for complete search history.

(56) References Cited

U.S. PATENT DOCUMENTS 4,327,955 A * 5/1982 Minter ..... H01R 12/82 439/260
4,387,665 A * 6/1983 Clinton ..... B05B 13/0468 118/314
5,129,841 A * 7/1992 Allina ..... H01R 13/115 439/508
5,632,655 A 5/1997 Camn
6,027,367 A * 2/2000 Woertz ..... H01R 4/2483 439/497
6,116,945 A * 9/2000 Davis ..... H01R 13/5825 439/354
6,132,234 A * 10/2000 Waidner ..... H01R 13/6273 439/358
6,146,166 A * 11/2000 Muzslay ..... H01R 13/052 439/176
6,152,769 A * 11/2000 Gimenes ..... H01R 13/5205 439/598
6,398,589 B1 * 6/2002 Congelliere ..... H01R 13/6397 439/655
6,722,902 B2 * 4/2004 Kedzierski ..... H01R 4/30 439/172
6,976,873 B2 * 12/2005 Taguchi ..... H01R 13/642 439/578
7,223,131 B2 * 5/2007 Moll ..... H01R 13/4361 439/595
7,347,745 B1 * 3/2008 Raudenbush ..... H01R 13/4223 439/595
7,540,775 B2 * 6/2009 Eckel ..... H01R 24/38 439/587
7,601,020 B2 * 10/2009 Yoshida ..... H01R 13/64 439/374
8,111,527 B2 * 2/2012 Loibl ..... H01R 27/02 361/829
8,214,961 B2 * 7/2012 Vinci ..... H01R 43/002 15/104.001
8,708,751 B2 * 4/2014 Lopes ..... H01R 31/06 439/651
8,905,787 B2 * 12/2014 Blakborn ..... H01R 13/18 439/607.41
10,112,559 B1 * 10/2018 Cimpean ..... E05B 81/16
D900,036 S * 10/2020 Wuester ..... D13/146
10,840,627 B1 * 11/2020 Su ..... H01R 13/424
10,856,416 B2 * 12/2020 Rasmussen ..... H05K 1/0281
10,931,069 B2 * 2/2021 Kunz ..... H01R 13/11
2008/0305671 A1 * 12/2008 Lehner ..... H01R 13/641 439/345
2018/0166836 A1 * 6/2018 Fritz ..... H01R 13/639

* cited by examiner

ELECTRICAL PLUG-IN CONNECTOR, INSULATING PROTECTIVE ELEMENT AND METHOD FOR ASSEMBLING AN ELECTRICAL PLUG-IN CONNECTOR

CROSS REFERENCE TO RELATED APPLICATIONS

Priority is hereby claimed under 35 U.S.C. § 119 to European Patent Application No. 19 186 433.9 which was filed in the European Patent Office on Jul. 16, 2019.

STATEMENT REGARDING FEDERALLY-SPONSORED RESEARCH OR DEVELOPMENT

Not applicable.

INCORPORATION BY REFERENCE

European Patent Application No. 19 186 433.9 which was filed in the European Patent Office on Jul. 16, 2019 is expressly incorporated herein by reference in its entirety to form part of the present disclosure.

FIELD OF INVENTION

The invention relates to the field of electrical connectors. More particularly, this invention relates to an electrical plug-in connector having an internal conductor contact element, an external conductor contact element and an insulating protective element which is arranged between the internal conductor contact element and the external conductor contact element and is displaceable between an assembly position and an insulating protecting position, the assembly position being a position in which an assembly access point is clear to permit fastening the internal conductor contact element to an internal conductor of the electrical cable, the insulating protection position being a position in which the assembly access point to the internal conductor contact element is blocked by the insulating protective element. The invention further relates to an insulating protective element for an electrical plug-in connector and to a method for assembling an electrical plug-in connector.

BACKGROUND

During the course of assembly of an electrical plug-in connector, the internal conductor contact elements of the plug-in connector have to be connected to their associated internal conductors of an electrical cable. In the case of shielded electrical plug-in connectors, an external conductor contact element which surrounds the internal conductor contact elements and has to be connected to an external conductor shield of the electrical cable is further provided.

The external conductor shield of the electrical cable is generally designed as an external conductor shielding braid comprising a plurality of individual wires which are intertwined with one another. In the case of inadequate design and guiding of the external conductor shielding braid or, in general, when connecting the external conductor shielding braid to the external conductor contact element of the electrical plug-in connector, individual wires of the braid can separate. These individual wires can ultimately establish an electrical connection or a short circuit between the internal conductor contact element and the external conductor contact element.

Irrespective of the field of use of the electrical plug-in connector, a short circuit between the internal conductor(s) and the external conductor owing to protruding individual wires of a cable shielding braid is a problem which has already been known for a long time. In order to reliably prevent protruding individual wires of the external conductor shielding braid of an electrical cable from making contact with the internal conductor contact elements, insulating parts or insulating protective elements are generally arranged between the internal conductor contact elements and the external conductor contact element. Said insulating parts or insulating protective element may be, for example, electrically insulating plastic rings or insulating housings of the electrical plug-in connector with individual receptacles for receiving the internal conductor contact elements.

In addition to the process reliability, a particularly economical production process and, in particular, also a short process time are also often required for manufacturing electrical plug-in connectors, in particular in order to be able to provide mass production. In this respect, a design of the electrical plug-in connector in the case of which an insulating part or insulating protective element is arranged between the internal conductor contact elements and the external conductor contact element is comparatively impractical since the options for fastening the internal conductor contact element to the internal conductors of the electrical cable are limited owing to the insulating protective element. In general, an insulating protective element which ensures a free assembly access point through mounting recesses in the external conductor contact element as far as the internal conductor contact elements is used. Owing to the assembly access point, for example assembly tools, in particular screwdrivers, can then be guided through the external conductor contact element for the purpose of fastening the internal conductor contact element to the internal conductor of the electrical cable.

However, owing to the assembly access point, the possibility of a short circuit on account of protruding individual wires of the external conductor shielding braid of the electrical cable arises once again. The possibility of a short circuit is reduced by said insulating protective element, but is not completely ruled out. This is not acceptable in particular for safety-critical applications, for example for high-voltage plug-in connectors, or for transmitting critical data signals, for example during the course of autonomous operation of a motor vehicle.

In order to solve the problem, EP 0 665 608 A2 proposes, for example, coating a screw, which is provided for connecting an internal conductor contact element to an internal conductor of the electrical cable, with an electrically insulating material in the region of the tip of the screw, which tip is connected to the internal conductor of the electrical cable. Therefore, even if an individual wire of the external conductor shielding braid of the cable makes electrical contact with the screw head through the assembly access point, a short circuit with the internal conductor of the cable still cannot occur.

However, coating the screw is comparatively complicated and expensive. Furthermore, a solution of this kind, in particular for safety-critical power cables or high-voltage cables, may sometimes still not be sufficiently reliable.

BRIEF SUMMARY OF THE INVENTION

In view of the known prior art, an object of the present invention is to provide an electrical plug-in connector which is suitable, in particular, for safety-critical applications and cost-effective mass production.

The present invention is also based on the object of providing an improved insulating protective element which can be used in an electrical plug-in connector in order to prevent a short circuit between an internal conductor contact element and an external conductor contact element, preferably without significantly increasing the expenditure on assembly of the electrical plug-in connector.

Finally, it is also an object of the invention to provide a method for assembling an electrical plug-in connector which can advantageously be suitable, in particular, for manufacturing a plug-in connector, which is suitable for safety-critical applications, employing a mass production process.

Embodiments of an electrical plug-in connector may have at least one internal conductor contact element, an external conductor contact element and an insulating protective element which is arranged between the internal conductor contact element and the external conductor contact element is provided. The external conductor contact element may have an assembly recess for providing an assembly access point for fastening the internal conductor contact element to an internal conductor of an electrical cable.

In principle, any desired plug-in connector which has any desired number of internal conductor contact elements can be provided within the scope of the invention. For example, an electrical plug-in connector can have precisely one internal conductor contact element or a plurality of internal conductor contact elements, for example two internal conductor contact element or more internal conductor contact elements, three internal conductor contact element or more internal conductor contact elements, four internal conductor contact element or even more internal conductor contact elements, within the scope of the invention. An electrical plug-in connector with precisely two internal conductor contact elements is preferably provided.

If an electrical plug-in connector with only one internal conductor contact element is provided, said electrical plug-in connector can preferably be designed as a coaxial plug-in connector.

The electrical plug-in connector is preferably designed as a plug-in connector for transmitting current or for supply to electrical assemblies. The plug-in connector can be designed as a low-voltage plug-in connector or as a high-voltage plug-in connector (for supply voltages of greater than 60 V). The electrical plug-in connector can be highly suitable, for example, advantageously for transmitting currents at voltages of less than one volt or else of more than 1000 V, for example also at voltages of 5 V to 500 V, preferably 12 V to 400 V, particularly preferably 24 V to 230 V, and very particularly preferably 48 V to 110 V, for example also 60 V. The plug-in connector can be highly suitable for transmitting direct current and also alternating current.

The electrical plug-in connector is particularly preferably designed as a plug-in connector for mobile radio technology, for example for supply to an active mobile radio antenna and/or a so-called remote radio unit, or for vehicle technology, for example for an electric vehicle.

In the present case, the term "vehicle" describes any means of transportation, in particular land vehicles, watercraft or aircraft, including spacecraft.

An electrical plug-in connector may be a plug, a panel plug, a socket, a coupling or an adapter. The term "plug-in connector" used within the scope of the invention is representative of all variants.

The assembly access point for fastening the internal conductor contact element to the internal conductor of the electrical cable can be designed, in particular, for inserting or guiding an assembly tool, for example a screwdriver for fastening a screw or a pressing tool.

According to the invention, provision is made for the insulating protective element to be able to be displaced between an assembly position, in which the assembly access point is cleared through the assembly recess to the internal conductor contact element, and an insulating protection position, in which the assembly access point to the internal conductor contact element is blocked by the insulating protective element.

Therefore, insulating protection against a short circuit between an internal conductor contact element of an electrical plug-in connector or an internal conductor of an electrical cable and an external conductor contact element of the electrical plug-in connector or an external conductor shield of the electrical cable can advantageously be provided according to the invention.

In an advantageous manner, an insulating protective element can be provided, which can already be pre-mounted between the external conductor contact element and the internal conductor contact element before the internal conductor contact element is fastened to an associated internal conductor of the electrical cable.

Owing to the ability to displace the insulating protective element after the at least one internal conductor contact element is fastened to the respective internal conductor of the cable, the assembly access point can be blocked, as a result of which undesirably protruding individual wires of an external conductor shielding braid of the cable cannot penetrate through the assembly access point to the internal conductor contact element or the internal conductor. A short circuit due to protruding individual wires can be virtually ruled out, for which reason a plug-in connector according to the invention can be suitable for safety-critical applications in particular.

At the same time, cost-effective assembly with a short process time can be maintained, as a result of which the electrical plug-in connector can be manufactured in an extremely economical manner in high numbers employing a mass production process.

In an advantageous development of the invention, provision can be made for the insulating protective element to have (at least) an access opening which, in the assembly position, is oriented in relation to the assembly recess in such a way that the assembly access point to the internal conductor contact element is cleared through the assembly recess and the access opening.

In the insulating protection position, the access opening can also be oriented in relation to the assembly recess in such a way that the assembly access point through the assembly recess to the internal conductor contact element is blocked by a continuous wall of the insulating protective element.

Therefore, an assembly access point in the form of an assembly duct through the external conductor contact element and the insulating protective element as far as the internal conductor contact element can be provided.

The access opening and the assembly recess are preferably oriented in alignment or coaxially in relation to one another in the assembly position of the insulating protective element.

A corresponding assembly recess is preferably provided in the external conductor contact element for each internal conductor contact element. If, for example, two internal conductor contact elements are provided, two assembly recesses can preferably also be provided in the external conductor contact element for providing a respective mounting access point.

However, in principle, an assembly recess which provides a common assembly access point for fitting a plurality of internal conductor contact elements can also be provided in the external conductor contact element. However, the design of the external conductor contact element with one assembly recess for each internal conductor contact element is preferred.

When a plurality of internal conductor contact elements are used, the insulating protective element preferably has one access opening for each internal conductor contact element. If, for example, two internal conductor contact elements are provided, two access openings can preferably be formed in the insulating protective element, which access openings, in the assembly position of the insulating protective element, are arranged in relation to the one or the plurality of assembly recesses in the external conductor contact element in such a way that at least one assembly access point is cleared for fitting one of the two internal conductor contact elements, preferably both assembly access points to both the internal conductor contact elements are cleared at the same time.

However, if a plurality of internal conductor contact elements are provided, the insulating protective element can also have a smaller number of access openings as internal conductor contact elements, for example even only one single access opening. The insulating protective element can then be displaced, for example, between a plurality of assembly positions and the insulating protection position. For example, a first assembly position can be provided, in which a first assembly access point is cleared through a first assembly recess to a first internal conductor contact element. Furthermore, a second assembly position can be provided, in which a second assembly access point is cleared through a second assembly recess to a second internal conductor contact element. However, a refinement of the invention according to which the insulating protective element has precisely one assembly position and one insulating protection position and can be displaced only between these two positions is preferred.

The number of internal conductor contact elements preferably corresponds to the number of assembly recesses and to the number of access openings.

According to a development of the invention, provision can be made for an insulating part to be arranged between the internal conductor contact element and the external conductor contact element, which insulating part has an assembly opening which, together with the assembly recess of the external conductor contact element, can provide the assembly access point.

In particular, the insulating part can be provided in order to provide a receptacle for the at least one internal conductor contact element in the electrical plug-in connector. The insulating part can be designed, for example, as an inner housing shell of the electrical plug-in connector.

The insulating part can principally ensure that no short circuit can occur between the external conductor contact element and the internal conductor contact element or elements. This primary insulating protection can then be advantageously combined with the insulating protective element according to the invention, in accordance with which the assembly access point for fastening the internal conductor contact element to the at least one internal conductor of the cable is cleared or blocked by the insulating protective element. The dimensions of the insulating protective element can be reduced and the design can be simplified when the plug-in connector additionally has the static or stationary insulating part between the internal conductor contact element(s) and the external conductor contact element and substantially only the dynamic portion or the moving part of the insulation has to be provided by the insulating protective element.

The insulating part and the insulating protective element are preferably parts which are independent of one another.

According to a development of the invention, provision can be made for the electrical plug-in connector to have a round geometry (or be designed as a round plug-in connector), wherein the external conductor contact element, the internal conductor contact element, the insulating part and/or the insulating protective element have/has a substantially round cross section, in particular a hollow-cylindrical, round cross section.

The invention can be highly suitable, in particular, for use with round plug-in connectors, wherein, however, any design of the plug-in connector is possible in principle. For example, rectangular plug-in connectors, for example flat plugs, can also be provided.

The electrical plug-in connector is not restricted to a specific type of plug-in connector, wherein the invention is suitable, in particular, for plug-in connectors for transmitting current and for plug-in connectors for high-frequency technology. Said electrical plug-in connector can be, in particular, a plug-in connector of the PL, BNC, TNC, SMBA (FAKRA), SMA, SMB, SMS, SMC, SMP, BMS, HFM (FAKRA Mini), H-MTD, BMK, Mini Coax or MATE-AX type.

The invention is very particularly advantageously suitable for plug-in connectors having internal conductor contact elements with a large cross section for transmitting high currents. Therefore, an electrical plug-in connector for supplying electrical power to electrical assemblies can be provided.

In a development of the invention, provision can be made for the insulating protective element to be guided in a groove of the external conductor contact element, in a groove of the internal conductor contact element, in a groove of the insulating part, in a groove which is formed between the insulating part and the external conductor contact element and/or in a groove which is formed between the insulating part and the internal conductor contact element.

The groove or the corresponding recess in the external conductor contact element can preferably be designed in such a way that it intersects the assembly recess.

The groove or the corresponding recess in the insulating part can preferably be designed in such a way that it intersects the assembly opening.

The groove or the corresponding recess is particularly preferably formed in a transition region between the external conductor contact element and the insulating part since this can be implemented in a particularly simple manner in terms of manufacture. However, in particular, a groove or a corresponding recess only in the external conductor contact element or only in the insulating part can also be possible. A groove can even be provided in the internal conductor contact element.

In a development of the invention, provision can be made for the assembly recess of the external conductor contact element, the access opening of the insulating protective element and/or the assembly opening of the insulating part to be designed as a bore or elongate hole.

A bore or an elongate hole can be implemented in a simple manner in terms of manufacture. However, other geometries for the assembly recess, the access opening and/or the assembly opening, in particular even a rectangular geometry, can also be provided in principle.

The assembly recess of the external conductor contact element is particularly preferably designed as an elongate hole or rectangular recess.

The access opening of the insulating protective element and the assembly opening of the optional insulating part are particularly preferably designed as a bore.

In an advantageous development of the invention, provision can be made for the internal conductor of the cable to be fastened to the internal conductor contact element by means of a screw. The assembly access point preferably runs in such a way that the screw can be operated by inserting an assembly tool into the assembly access point.

Within the scope of the invention, the screw can be considered to be a constituent part of the electrical plug-in connector.

A metal screw is preferably provided.

In an advantageous development of the invention, provision can be made for the screw to be completely covered by the insulating protective element in the insulating protection position of the insulating protective element.

Particularly reliable insulating protection against short circuits can be provided in this way.

In a development of the invention, provision can be made for the diameter of a screw head of the screw to be larger than the diameter of the access opening of the insulating protective element.

If the diameter of the screw head of the screw is larger than the diameter of the access opening of the insulating protective element, for example is larger than the diameter of a bore of the insulating protective element, it is advantageously possible to prevent the screw from being accidentally lost through the access opening in a preassembled delivery state.

In particular, the diameter of the access opening of the insulating protective element can be larger than the diameter of the assembly tool and smaller than the diameter of the screw head. In this way, the assembly tool can be guided through the access opening but, at the same time, a screw which was already previously inserted can no longer be lost through the access opening of the insulating protective element.

In an advantageous development of the invention, provision can be made for the insulating protective element to have latching means for latching with a corresponding latching element of the external conductor contact element, of the internal conductor contact element and/or of the insulating part in order to latch the insulating protective element in the assembly position and/or in the insulating protection position.

The insulating protective element can preferably be latchable at least in the insulating protection position. However, the insulating protective element can particularly preferably be latchable both in the assembly position and in the insulating protection position.

The latching is preferably performed with the insulating part or with another housing component of the electrical plug-in connector.

Provision can be made for a latching lug which is formed laterally on the insulating protective element or a pin to be guided by means of a rail guide with one or two latching recesses in the assembly recess of the external conductor contact element. However, the latching lug or the pin is preferably guided in a corresponding rail guide with one or two latching recess in the insulating part.

Axial latching arrangements or axially extending latching means, but also radially running latching means, can be provided in the insulating protective element. Axial latching means are preferably provided.

The latching means, for example latching lugs, of the insulating protective element can be formed, for example, on an elastic spring arm of the insulating protective element, for example at a free end of the spring arm or in the middle (or in a middle section) of a spring arm which is attached on both sides.

The spring arm can be implemented in a particularly advantageous manner by means of an elongate hole or one or more slots along the periphery of the insulating protective element.

The deformability or the elasticity of the spring arm can be selected in such a way that the spring arm provides a sufficient holding force for the latching arrangement and can reversibly bend to a sufficient extent during the latching operation or during release of the latching arrangement, without undergoing (irreversible) plastic deformation.

The spring mechanism, in particular based on a spring arm, can be used to only deliberately trigger displacement of the insulating protective element from the insulating protection position to the assembly position (or vice versa). The spring mechanism can be defined by the material of the insulating protective element and by the geometry of the insulating part and of the external conductor contact element. The interaction between the insulating part, the external conductor contact element and the insulating protective element can be tuned in order to adjust the force which is required for moving the insulating protective element (starting from the assembly position and/or insulating protection position).

In an advantageous development of the invention, provision can be made for the insulating protective element to be of partially annular or annular design, wherein the insulating protective element can be displaced rotationally and/or axially between the assembly position and the insulating protection position with respect to the longitudinal axis of the electrical plug-in connector.

The insulating protective element is particularly preferably of partially annular or annular design and can be displaced rotationally with respect to the longitudinal axis of the electrical plug-in connector. The movement of the insulating protective element between the assembly position and the insulating protection position can therefore take place due to a rotational movement about the center axis of the plug-in connector. However, axial displacement can also be provided in principle.

In principle, the displacement of the insulating protective element between the assembly position and the insulating protection position can even have a rotational or radial and an axial component. For example, a slotted guide for guiding a sliding block of the insulating protective element can be provided in the electrical plug-in connector, for example in the insulating part or the external conductor contact element, for a movement of said kind.

The use of an insulating protective element which is of partially annular or annular design can be highly suitable, in particular, for use with an electrical plug-in connector with a round geometry.

A plurality of insulating protective elements (partially annular, annular or platelet-like) can also be provided within the scope of the invention, for example an insulating protective element for each internal conductor contact element or for each screw for fastening the internal conductor contact element. In particular, a respective partially annular insulating protective element or a respective platelet-like insulating protective element (still to be described below) can then be provided for each internal conductor contact element or for each screw which is provided for fastening the internal conductor contact elements.

As indicated above, in one refinement of the invention, provision can also be made for the insulating protective element to be of platelet-like design, wherein the insulating protective element can be displaced axially between the assembly position and the insulating protection position with respect to the longitudinal axis of the electrical plug-in connector.

A platelet-like insulating protective element can be highly suitable, in particular, for use with an electrical plug-in connector with a rectangular, in particular flat, geometry.

In a development of the invention, provision can be made for the insulating protective element to have at least one guide means, in particular a radially or axially protruding lug or a web in order to be able to displace the insulating protective element in its fitted state within the external conductor contact element.

Therefore, the insulating protective element can advantageously be displaceable from the outside, for example by means of the assembly tool or else a finger of the fitter or user of the plug-in connector.

The at least one guide means can also be shaped in the form of at least one groove or at least one cutout, for example also in the form of channels in the outer wall of the insulating protective element.

However, a separate guide means can optionally also be dispensed with. For example, the insulating protective element itself or the access opening of the insulating protective element can be used for displacing the insulating protective element. For example, the assembly tool which is provided for fastening the internal conductor contact element (or a finger of the fitter) can be partially inserted into the access opening and the insulating protective element can then be displaced by means of initiating the movement at the access opening. In particular, an assembly recess, which is designed as an elongate hole or rectangular elongate recess, in the external conductor contact element can be highly suitable for this variant.

According to a development of the invention, provision can be made for a plurality of internal conductor contact elements, preferably two internal conductor contact elements or even more internal conductor contact elements, and a number of corresponding assembly recesses and access openings to be provided.

As already mentioned, the invention is suitable, in particular, for use with a plug-in connector having any desired number of internal conductor contact elements. However, two internal conductor contact elements are particularly preferably provided, the respective fastening of which to an internal conductor of the electrical cable is rendered possible through a respective assembly access point by corresponding assembly recesses or access openings.

The invention also relates to an insulating protective element for an electrical plug-in connector, wherein the insulating protective element is arranged between (at least) an internal conductor contact element and an external conductor contact element of an electrical plug-in connector. The insulating protective element can be displaced between an assembly position and an insulating protection position. In the assembly position, the insulating protective element clears (at least) an assembly access point through an (at least one) assembly recess, which is provided in the external conductor contact element, for fastening the internal conductor contact element to an internal conductor of an electrical cable. In the insulating protection position, the insulating protective element blocks the assembly access point.

According to the invention, a captive electrically insulating protective element for protecting against a short circuit between the internal conductor or the internal conductors and an external conductor shield of an electrical cable can be provided.

In the insulating protection position, conductive screws, which are used in particular for fastening the internal conductor contact element to the internal conductor, can be completely electrically insulated, as a result of which no electrical connection can be established between the external conductor shield of the cable and the internal conductor contact element.

The insulating protective element can also be used to permanently protect against the loss of clamping screws or screws for fastening internal conductor contact elements to internal conductors of the cable.

The insulating protective element according to the invention is particularly cost-optimized and can be extremely easy to install as part of assembly of the electrical plug-in connector and, in particular, can also be suitable for mass production of plug-in connectors.

The insulating protective element can optionally also have an assembly prevention means, for example a lug which extends axially in the direction of the cable, in order to block final assembly of the electrical plug-in connector, in particular in terms of screwing on a lock nut, a lock sleeve or another plug-in connector component, in an interlocking manner if the insulating protective element is not in the insulating protection position.

The invention also relates to a method for assembling an electrical plug-in connector which has (at least) an internal conductor contact element, an external conductor contact element and an insulating protective element which is arranged between the external conductor contact element and the internal conductor contact element. At least the following method steps are provided within the scope of the method according to the invention:

a) displacing the insulating protective element into an assembly position in which (at least) an assembly access point to the internal conductor contact element is cleared through (at least) an assembly recess which is provided in the external conductor contact element;
b) fastening the internal conductor contact element to an internal conductor of an electrical cable through the cleared assembly access point; and
c) displacing the insulating protective element into an insulating protection position in which the assembly access point to the internal conductor contact element is blocked by the insulating protective element.

The abovementioned first method step (displacing the insulating protective element into the assembly position) can, in particular, already implicitly take place as part of preassembly of the insulating protective element.

The method step of fastening the internal conductor contact element or elements to corresponding internal conductors of the cable can preferably take place by pressing or clamping the internal conductor in a cylindrical internal conductor contact element by means of a screw.

For the purpose of fastening the internal conductor contact element, an assembly tool, for example a screwdriver, can be guided through the assembly access point when the insulating protective element is in the assembly position.

The insulating protective element can be displaced between the assembly position and the insulating protection position by rotation in particular.

It is advantageously possible to ensure that, in particular, screw heads for fastening the internal conductor contact elements are not undesirably visible and as a result a short circuit is possible.

Provision can be made for the insulating protective element to latch with a plug-in connector component, for example an inner housing shell or an insulating part, in the assembly position and/or (in particular) in the insulating protection position. Particularly when latching is provided in the insulating protection position, the insulating protective element cannot be undesirably moved back or over-rotated to its assembly position again. In this way, it is possible to ensure that the insulating protective element does not automatically move back due to vibrations or shocks during assembly, transportation and/or use of the plug-in connector. The insulating protective element may be moved back to the assembly position again only with deliberate application of increased force.

Since the insulating protective element according to the invention can optionally be pre-mounted in the external conductor contact element, preferably within a groove of the external conductor contact element, of an insulating part or a groove which is formed between the external conductor contact element and the insulating part, said insulating protective element cannot be forgotten by the installation engineer when installing the cable.

If the diameter of the access opening of the insulating protective element is smaller than the diameter of a screw head of a screw used, the insulating protective element can additionally prevent the clamping screw from becoming lost at any time—even in the assembly position. Therefore, the screws used cannot be lost even in a loose delivery state within the insulating protective element.

Conventional screwdrivers can advantageously be used for fitting the internal conductor contact elements to the internal conductors of the cable. Therefore, special tools are not absolutely necessary.

The invention is suitable particularly for use with round plug-in connectors and very particularly for round plug-in connectors in which one or more internal conductor contact elements have to be clamped to internal conductors of an electrical cable by screws and separated from an external conductor shield of the cable.

The invention also relates to the advantageous use of an electrical plug-in connector according to the above and following embodiments for supplying power to active mobile radio antennas.

For the purpose of supplying power to active mobile radio antennas, comparatively high currents (e.g. 50 amperes at 60 volts) are required for example. The line cross section of the internal conductor of the transmission cable which is used on a mobile radio mast is designed to be of a corresponding size. In a corresponding plug-in power connector, the internal conductors of the cable can therefore preferably be fastened by means of a screw arrangement. In general, in each case one metal screw is used for each internal conductor, said metal screw being fed radially through the assembly recess of the external conductor contact element and screwed into an aligned threaded bore which is provided in the insulating part or in the internal conductor contact element. Finally, an earthing shield or an external conductor shield of the electrical cable can be guided over the outer surface of the external conductor contact element.

Owing to the insulating protective element according to the invention, an undesired short circuit between an internal conductor and the external conductor shield of the cable can then be reliably prevented by displacing the insulating protective element into the insulating protection position in accordance with the invention.

Furthermore, the invention relates to an electrical plug-in connection comprising an electrical plug-in connector according to the above and following embodiments and also an electrical mating plug-in connector which can be connected to the electrical plug-in connector.

Finally, the invention also relates to a vehicle having at least one electrical plug-in connector according to the above and following embodiments or to a mobile radio antenna with an electrical plug-in connector according to the above and following embodiments.

The invention also relates to an assembly-preventing arrangement for an insulating protective element. The insulating protective element can preferably be designed in accordance with the above and following information. However, in principle, the assembly-preventing arrangement can be suitable for any desired insulating protective elements. The assembly-preventing arrangement can be designed in order to block final assembly of an electrical plug-in connector in an interlocking manner when the insulating protective element is not in an insulating protection position (in particular an insulating protection position described above and below). The assembly-preventing arrangement can also be designed in order to block insertion of a mating plug-in connector into the plug-in connector in an interlocking manner when the insulating protective element is not in an insulating protection position (in particular an insulating protection position described above and below). The assembly-preventing arrangement can preferably have a lug which extends axially or radially in the direction of the cable.

Features which have been described in conjunction with the electrical plug-in connector according to the invention can of course also be implemented for the insulating protective element, the electrical plug-in connection, the use according to the invention, the vehicle, the mobile radio antenna, the assembly method and the assembly-preventing arrangement—and vice versa. Furthermore, advantages which have already been mentioned in conjunction with the electrical plug-in connector according to the invention can also be understood as relating to the insulating protective element, the electrical plug-in connection, the use according to the invention, the vehicle, the mobile radio antenna, the assembly method and the assembly-preventing arrangement and vice versa.

It should additionally be pointed out that terms such as "comprising", "having" or "with" do not exclude other features or steps. Furthermore, terms such as "a(n)" or "the" indicating steps or features in the singular do not exclude a plurality of features or steps and vice versa.

However, in a puristic embodiment of the invention, provision can also be made for the features which are introduced in the invention by the terms "comprising", "having" or "with" to be exhaustively listed. Accordingly, one or more lists can be considered to be exhaustive within the scope of the invention, for example for each claim in each case. The invention can, for example, consist exclusively of the features cited in Claim 1.

It should further be noted that the values and parameters described in the present case include deviations or fluctuations of ±10% or less, preferably ±5% or less, further preferably ±1% or less, and very particularly preferably ±0.1% or less, in the respectively mentioned value or parameter, provided that these deviations are not ruled out in practice when implementing the invention. The indication of ranges by start and end values also comprises all those values and fractions which are included by the respectively mentioned range, in particular the start and end values and a respective average value.

Exemplary embodiments of the invention will be described in more detail with reference to the drawings which schematically show preferred exemplary embodiments in which individual features of the present invention may be illustrated in combination with one another. Features of an exemplary embodiment can also be implemented separately from the other features of the same exemplary embodiment, and can accordingly be readily combined by a person skilled in the art with features of other exemplary embodiments in order to form further meaningful combinations and sub-combinations. In the figures, functionally identical elements are provided with the same reference symbols.

DETAILED DESCRIPTIONS OF PREFERRED EMBODIMENTS

Figure 1:
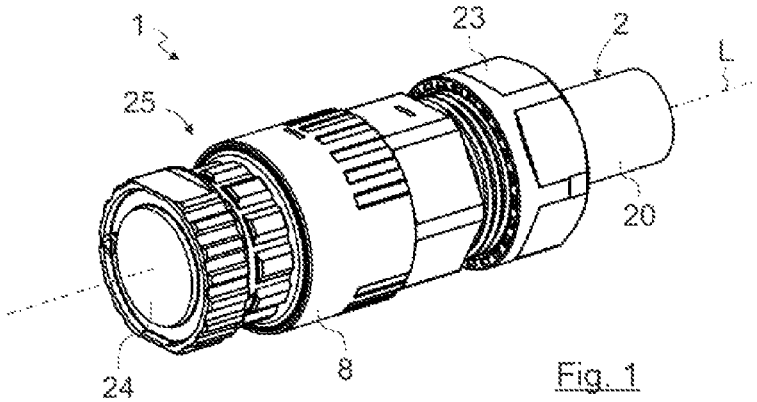
FIG. 1 shows a perspective illustration of an electrical plug-in connector according to the invention and an electrical cable.

FIG. 1 shows a perspective illustration of an electrical plug-in connector 1 according to the invention. The electrical plug-in connector 1 is illustrated in a manner connected to an electrical cable 2 by way of example.

The invention is described, merely by way of example, with reference to embodiments of electrical plug-in connector 1 illustrated in the figures. In principle, an electrical plug-in connector according to the invention can have any desired design, for example a coaxial design, a triaxial design or another design. In the exemplary embodiment, the electrical plug-in connector 1 has, by way of example, a round geometry. However, in principle, the invention can also be suitable for use with a rectangular plug-in connector, for example a flat plug-in connector.

Figure 2:
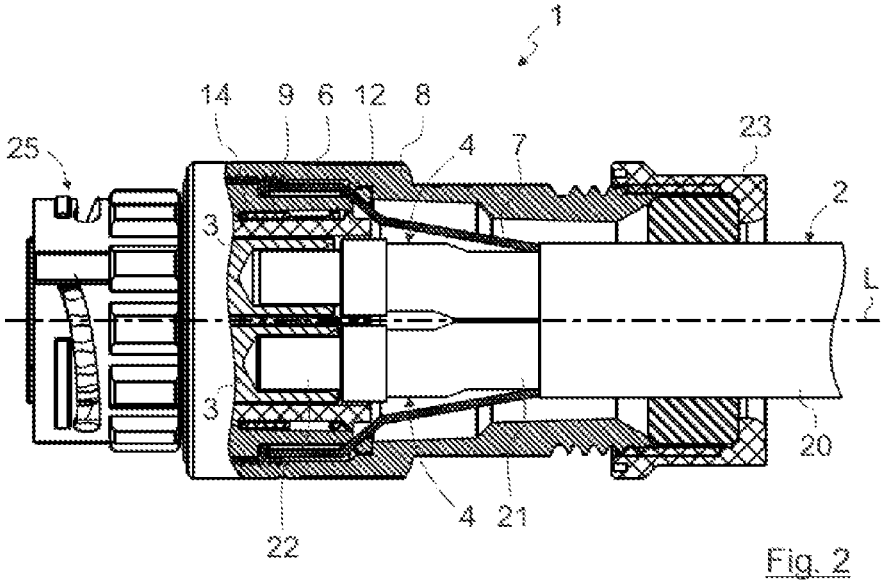
FIG. 2 shows a partial section through the electrical plug-in connector and the electrical cable of FIG. 1.
Figure 3:
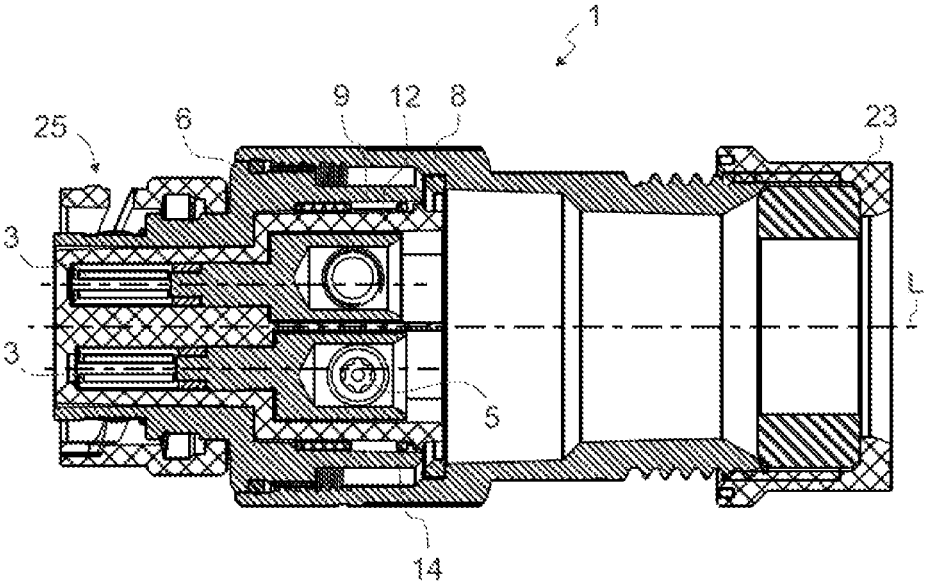
FIG. 3 shows a further sectional illustration of the electrical plug-in connector of FIG. 1 with the cable blanked out.

FIGS. 2 and 3 show sectional illustrations of the plug-in connector 1 illustrated in FIG. 1 in the longitudinal direction, that is to say along the longitudinal axis L or along the center axis of the electrical plug-in connector 1, wherein FIG. 2 shows a partial section through the rear region of the plug-in connector 1 together with the electrical cable 2 and FIG. 3 shows a complete section through the plug-in connector 1 without the electrical cable 2.

The electrical plug-in connector 1 has two internal conductor contact elements 3 (cf., in particular, FIG. 3). This is to be understood as merely exemplary. In principle, the electrical plug-in connector 1 can have any desired number of internal conductor contact elements 3, for example even only one internal conductor contact element 3. The internal conductor contact elements 3 are provided for making contact with mating contact elements of a corresponding mating plug-in connector (not illustrated) and are to be electrically connected to the internal conductors 4 of the electrical cable 2, as can be seen particularly clearly in FIG. 2.

The electrical plug-in connector 1 illustrated is designed, by way of example, for transmitting high currents. To this end, the internal conductors 4 of the cable 2 can particularly advantageously be fastened to the internal conductor contact elements 3 or clamped thereto by means of a screw 5 (cf., inter alia, FIG. 3). To this end, the screws 5 can particularly advantageously be fitted from opposite sides of the plug-in connector 1, as illustrated in the exemplary embodiments. For example, a first screw 5 can be provided for connecting a first internal conductor 4 to a first internal conductor contact element 3, starting from a first side of the plug-in connector 1, and a second screw 5 can be provided for fitting a second internal conductor 4 to a second internal conductor contact element 3, starting from a side of the plug-in connector 1 that is opposite the first side. However, in principle, fitting can also be performed from the same side of the plug-in connector 1 or starting from any desired direction.

The electrical plug-in connector 1 further has an external conductor contact element 6 which runs around the internal conductor contact elements 3 for electromagnetic shielding purposes. The external conductor contact element 6 is connected to an external conductor shield, in particular an external conductor shielding braid 7 of the electrical cable 2 (cf., inter alia, FIG. 2). To this end, the external conductor shielding braid 7 can be pressed or clamped, for example, between the external conductor contact element 6 and an external housing 8 of the plug-in connector 1, as illustrated in FIG. 2 for example. To this end, the external housing 8 can be screwed, for example, onto the external conductor contact element 6, as will be described further below as part of the assembly method in FIGS. 15 to 20. In preferred embodiments, the external housing 8 may be electrically conductive.

Figure 4:
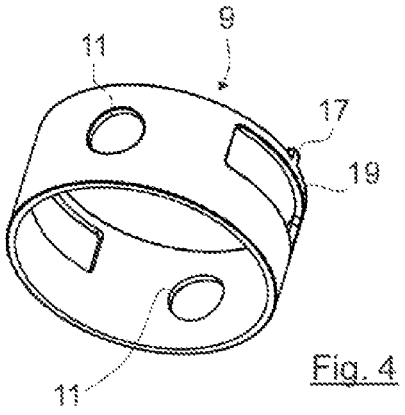
FIG. 4 shows a perspective illustration of an annular insulating protective element according to the invention.

In order to prevent the protruding individual wires of the external conductor shielding braid 7 from unintentionally establishing short circuits with one of the internal conductor contact elements 3, an insulating protective element 9 is arranged between the external conductor contact element 6 and the internal conductor contact elements 3. The insulating protective element 9 of the plug-in connector 1 illustrated in FIGS. 1 to 3, 5 to 11 and 15 to 20 is of annular design and illustrated in a perspective manner in FIG. 4 by way of example.

For the purpose of providing an assembly access point M (indicated in FIG. 5 by way of example) for fastening the internal conductor contact elements 3 to the respective internal conductors 4 of the electrical cable 2, corresponding assembly recesses 10 are provided in the external conductor contact element 6, which assembly recesses are particularly advantageously designed as an elongate hole (cf., for example, FIGS. 6, 9 as well as 13 and 14) in the exemplary embodiments.

Figure 9:
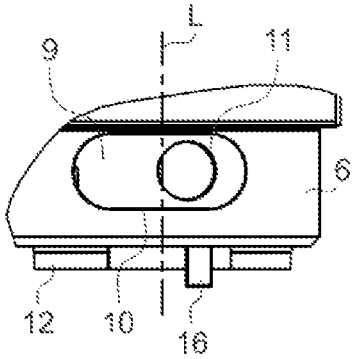
FIG. 9 shows the electrical plug-in connector of FIG. 6 with the insulating protective element in the insulating protection position.
Figure 10:
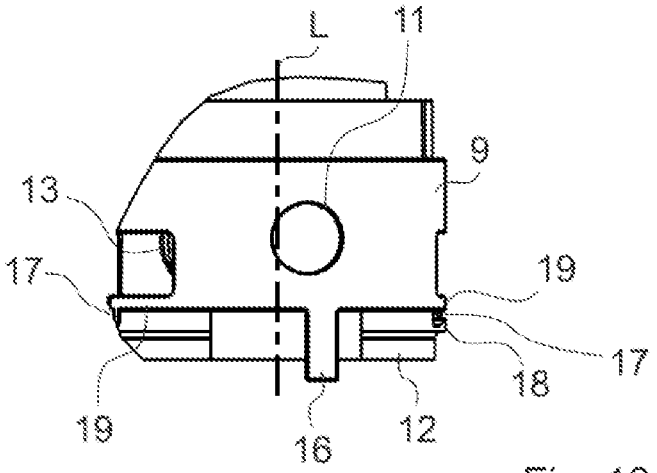
FIG. 10 shows the electrical plug-in connector of FIG. 6 with the insulating protective element in the insulating protection position and the blanked-out external conductor contact element.
Figure 11:
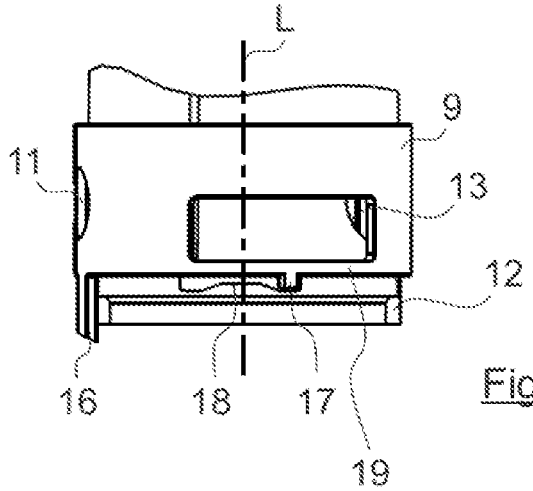
FIG. 11 shows the electrical plug-in connector of FIG. 6 with the insulating protective element in the insulating protection position, with the external conductor contact element blanked out and in a view which is rotated through 90° for the purpose of illustrating latching means of the insulating protective element.
Figure 13:
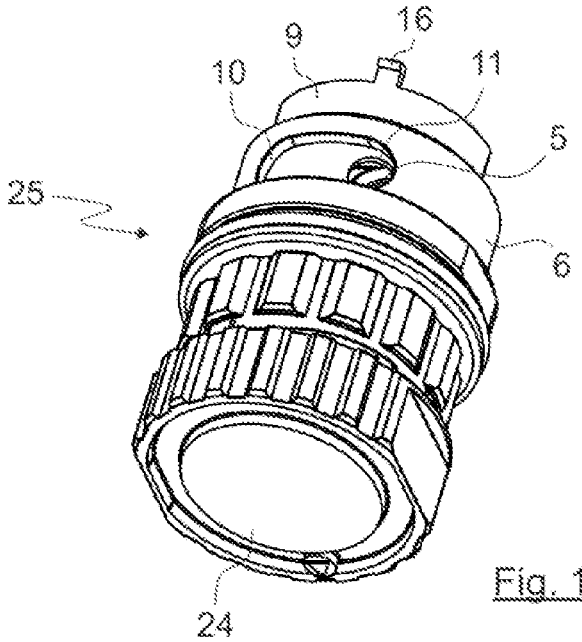
FIG. 13 shows a perspective illustration of a front housing assembly of an electrical plug-in connector with the partially annular insulating protective element of FIG. 12 in the assembly position.
Figure 14:
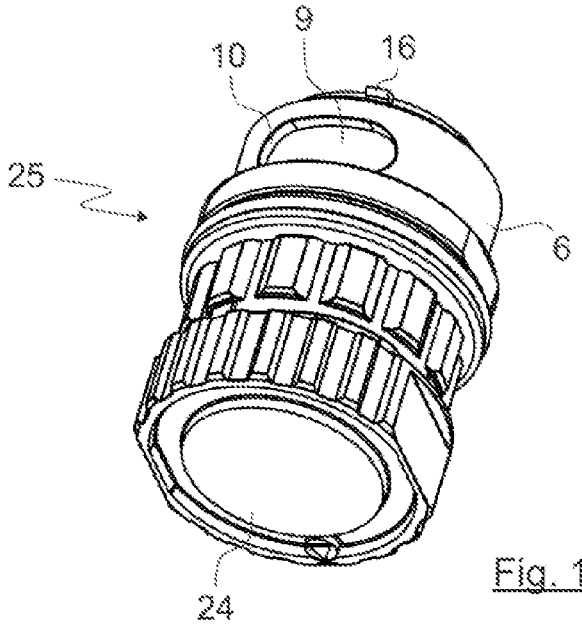
FIG. 14 shows the front housing assembly of the electrical plug-in connector of FIG. 13 with the partially annular insulating protective element of FIG. 12 in the insulating protection position.

According to the invention, the insulating protective element 9 can be displaced between an assembly position (cf., for example, the orientation in FIG. 6 or in FIG. 13) and an insulating protection position (cf., for example, the orientation in FIG. 9 or in FIG. 14). In the assembly position, the insulating protective element 9 is arranged relative to the external conductor contact element 6 in such a way that the assembly access point M is cleared through the assembly recesses 10 of the external conductor contact element 6 as far as the respective internal conductor contact element 3. However, in the insulating protection position, the assembly access point M is blocked by the insulating protective element 9.

To this end, the insulating protective element 9 preferably has at least one access opening 11. In the exemplary embodiments, a separate access opening 11 and a separate assembly recess 10 are provided for each internal conductor contact element 3 and, respectively, for each assembly access point M. In the assembly position, the access opening 11 is oriented in relation to the assembly recess 10 in such a way that the assembly access point M to the respective internal conductor contact element 3 is cleared through the assembly recess 10 and the access opening 11. However, in the insulating protection position, the access opening 11 is correspondingly displaced and the assembly access point M is blocked as a result.

The electrical plug-in connector 1 optionally has an insulating part 12 between the internal conductor contact elements 3 and the external conductor contact element 6. In the present case, the insulating protective element 9 is guided between the insulating part 12 and the external conductor contact element 6, wherein the insulating protective element 9 can also be guided between the insulating part 12 and the internal conductor contact elements 3 in principle. In order to ensure the assembly access point M in the case of the insulating protective element 9 being in the assembly position, the insulating part 12 has assembly openings 13 (cf. FIG. 5) which correspond to the assembly recesses 10 and are arranged in alignment with the assembly recesses 10 of the external conductor contact element 6.

In the exemplary embodiments shown in FIGS. 1 to 11 and 15 to 20, the insulating protective element 9 can be displaced rotationally between the assembly position and the insulating protection position with respect to the longitudinal axis L of the electrical plug-in connector 1. To this end, the insulating protective element 9 is guided in a recess or groove 14 which is formed between the insulating part 12 and the external conductor contact element 6. However, in principle, the insulating protective element 9 can, for example, also be guided exclusively in a groove of the external conductor contact element 6, in a groove of the internal conductor contact element 3 or even in a groove of the insulating part 12. The insulating protective element 9 can also be guided in a groove which is formed between the insulating part 12 and the internal conductor contact element 3.

In the exemplary embodiments, the access opening 11 of the insulating protective element 9 is designed as a bore by way of example. However, the access opening 11 can also be designed as an elongate hole or as another recess, for example also as a rectangular recess. This analogously applies to the assembly recess 10 of the external conductor contact element 6 and the assembly opening 13 of the insulating part 12 too.

Figure 5:
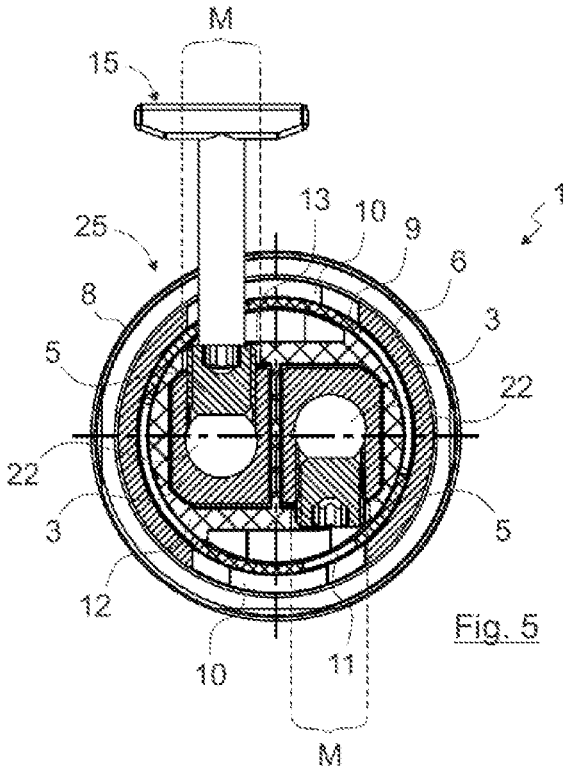
FIG. 5 shows a cross section through the electrical plug-in connector of FIG. 1 for illustrating the fastening of the internal conductor contact elements by means of an assembly tool which is inserted through the assembly access point.

FIG. 5 shows, with reference to a cross section through the plug-in connector 1, the fastening of the internal conductor contact elements 3 to the internal conductors 4 of the electrical cable 2 through the cleared assembly access point M by way of example. An assembly tool, for example the illustrated screwdriver 15, can be guided through the assembly access point M, which can be provided by the orientation of the insulating protective element 9 into the assembly position, through the assembly recesses 10, assembly openings 13 and access openings 11 as far as the screws 5, in order to clamp the internal conductors 4 within the hollow-cylindrical internal conductor contact elements 3 by tightening the screws 5. Torx® brand screws 5 are illustrated purely by way of example; any desired types of screw can be provided in principle. As an alternative, crimping or pressing or soldering of the internal conductor contact elements 3 and the internal conductors 4 can also be provided using a corresponding suitable assembly tool.

In order to prevent the screws 5 from being lost, provision can be made for the diameter of the screw heads of the screws 5 to be larger than the diameter of the access opening 11 of the insulating protective element 9. As a result, the assembly tool 15 can be guided through the access opening 11 but the screws 5 are not lost, even if they are only loosely contained in the insulating protective element 9 in a delivery state.

FIGS. 6 to 11 are used to further illustrate the functioning of the insulating protective element 9 and the electrical plug-in connector 1.

Figure 6:
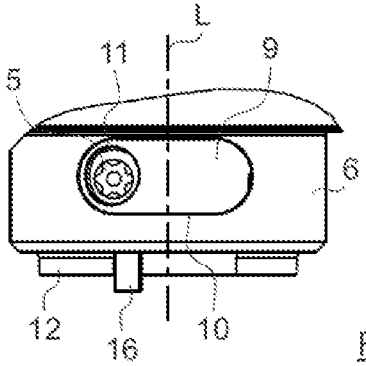
FIG. 6 shows a detail of an electrical plug-in connector according to a second exemplary embodiment with an annular insulating protective element in the assembly position with a lug, which protrudes axially out of the external conductor contact element, for initiating the displacement.
Figure 7:
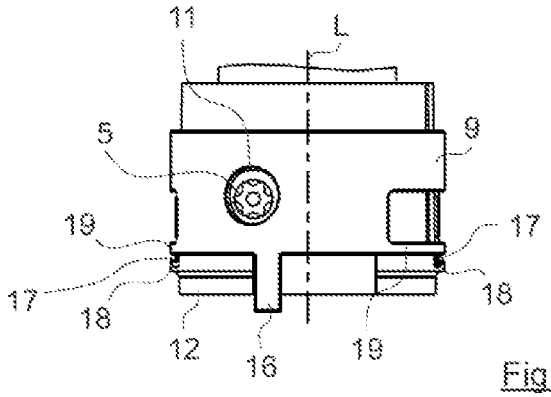
FIG. 7 shows the electrical plug-in connector of FIG. 6 with the external conductor contact element blanked out.
Figure 8:
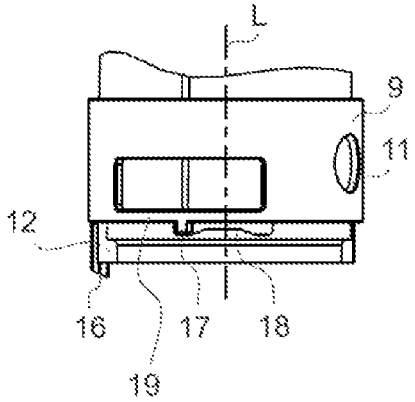
FIG. 8 shows the electrical plug-in connector of FIG. 6 with the external conductor contact element blanked out in a view which is rotated through 90° for the purpose of illustrating latching means of the insulating protective element.

FIG. 6 illustrates the insulating protective element 9 within the external conductor contact element 6 in its assembly position, and FIG. 9 illustrates said insulating protective element in its insulating protection position. The insulating protective element 9 was, as shown in FIG. 9, rotationally displaced in order to reach the insulating protection position, as a result of which the assembly access point M is blocked and therefore the screw 5 is covered too. As a result, the situation of protruding individual wires of the external conductor shielding braid 7 of the cable 2 making unintentional electrical contact with the screw 5 or the internal conductor contact element 3 is no longer possible.

In the variant of the insulating protective element 9 shown in FIGS. 6 to 11, the insulating protective element 9 has, in a departure from the exemplary embodiments shown in FIGS. 1 to 5 and 15 to 20, additional guide means 16, in the present case lugs which protrude axially from the insulating protective element 9, as a result of which the insulating protective element 9 can be displaced particularly conveniently by the user in its assembled state within the external conductor contact element 6. For the purpose of better illustration, the external conductor contact element 6 is blanked out in FIGS. 7 and 10. However, in principle, a corresponding guide means 16 can also be dispensed with. Therefore, for example, the user or the fitter can also displace the insulating protective element 9 using a finger or the assembly tool 15, in particular if the assembly recess 10 of the external conductor contact element 6, as illustrated, is designed as an elongate hole and therefore grants sufficient access to the insulating protective element 9.

The figures further illustrate a possible way of latching the insulating protective element 9 in the assembly position and in the insulating protection position. This can be seen particularly clearly in FIGS. 4, 8, 11 and 12. To this end, the insulating protective element 9 has axially protruding latching means 17 which interact with corresponding latching elements 18 of the insulating part 12, which are designed as a rail guide by way of example.

Any desired number of latching means 17 and latching elements 18, for example even only one latching means 17 and one corresponding latching element 18, can be provided in principle; in the exemplary embodiment, two latching means 17 and two latching elements 18 are illustrated on opposite sides of the insulating protective element 9 and, respectively, of the insulating part 12 by way of example.

In the exemplary embodiment, a latching arrangement is provided in the assembly position and in the insulating protection position. However, in principle, a latching arrangement can also be provided only in the assembly position or in the insulating protection position. At least one latching arrangement can particularly advantageously be in the insulating protection position since the insulating protective element 9 can then not be unintentionally (for example during subsequent use of the plug-in connector 1) moved back to the "unsecure" assembly position again.

In order to make the latching arrangement releasable at least with application of increased force, the latching means 17 of the insulating protective element 9 according to FIGS. 1 to 11 is designed in the middle of an elastic spring arm 19. The spring arm 19 is formed, by way of example, by an elongate hole-like recess in the insulating protective element 9. However, in principle, the spring arm 19 can also be shaped in a different way. Furthermore, the latching means 17 can also be fastened to a free end of the spring arm 19.

The insulating protective element 9 does not necessarily have to be latched to the insulating part 12 (which is optional in any case). The insulating protective element 9 can also be latched to the external conductor contact element 6 or even to one of the internal conductor contact elements 3. Latching with any desired plug-in connector component of the plug-in connector 1 can be provided in principle.

The insulating protective element 9 can also be of only partially annular design, wherein an insulating protective element 9 can particularly advantageously be provided for each internal conductor contact element 3 in this case. An exemplary insulating protective element 9 of partially annular design is illustrated in a perspective manner in FIG. 12.

Figure 12:
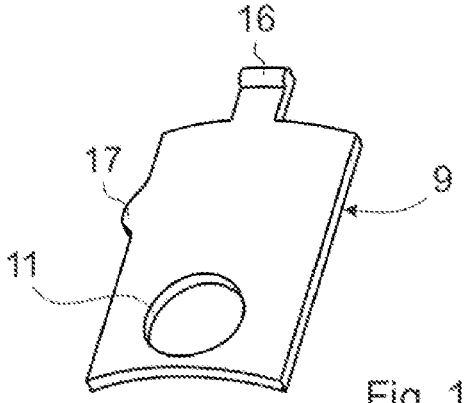
FIG. 12 shows a perspective illustration of a partially annular insulating protective element according to the invention.

The partially annular insulating protective element 9 of FIG. 12 can likewise be displaced rotationally between the assembly position and the insulating protection position with respect to the longitudinal axis L of the electrical plug-in connector 1. However, in the case of a partially annular insulating protective element 9, axial displacement between the assembly position and the insulating protection position can also be advantageous. Axial displacement of this kind is illustrated, by way of example, in FIGS. 13 and 14.

FIG. 13 shows the partially annular insulating protective element 9 within the external conductor contact element 6 in its assembly position, as a result of which the assembly access point M to the corresponding internal conductor contact element 3 is cleared.

FIG. 14 shows the partially annular insulating protective element 9 in its insulating protection position. The assembly access point M in the plug-in connector 1 illustrated in FIG. 14 is therefore blocked owing to the axial displacement of the insulating protective element 9 or its access opening 11 relative to the assembly recess 10 of the external conductor contact element 6.

The guide means 16 shown in FIGS. 12 to 14 (likewise an axially projecting lug) can be used for the purpose of initiating the axial displacement of the insulating protective element 9. Furthermore, the partially annular insulating protective element 9 can also latch in the external conductor contact element 6, in the insulating part 12 and/or in the internal conductor contact element 3 in the assembly position and/or the insulating protection position, for which reason a laterally protruding latching means 17 is shown in FIG. 12 by way of example.

The insulating protective element 9 can also be of platelet-like design (not illustrated further in the exemplary embodiments) in the case of axial displacement of the insulating protective element 9 in particular.

FIGS. 15 to 20 show a method according to the invention for assembling the electrical plug-in connector 1 with reference to a few exemplary method steps. It should be noted that further method steps can also be provided in principle. In particular, method steps can also be dispensed with within the scope of the invention; the figures therefore show, in particular, only optional method steps too. Furthermore, the order of the method steps can vary.

Initially, provision can be made for the electrical cable 2 to be prepared or prefabricated for making contact with the electrical plug-in connector 1. To this end, the electrical cable 2 can be free of a cable sheath 20 at its end which is to be processed. The external conductor shielding braid 7 can then be pushed toward the rear over the remaining cable sheath 20. A filler layer (not illustrated in figures) which guides the internal conductors 4 jointly in itself, and a cable film (likewise not illustrated) which may be present can then be removed in order to separate the internal conductors 4 and to make them accessible for further processing. The individual internal conductors 4 can then be freed of the insulation 21 in a front section and the cores of the internal conductors 4 can be exposed. Core sleeves 22 can in turn then be connected, for example crimped or soldered, to the exposed cores of the internal conductors 4. This state of the cable is illustrated in FIG. 15.

Figure 15:
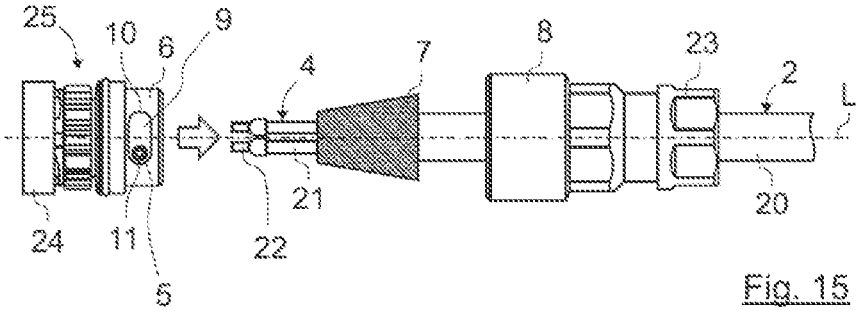
FIG. 15 shows a first method step of an assembly method for a plug-in connector according to the invention.

In FIG. 15, the external housing 8 and also a lock nut 23 are furthermore already pushed onto the cable sheath 20 of the cable 2 for subsequent fitting. In the method step illustrated in FIG. 15, the front housing assembly 25 (also known by the term "connector head"), which consists of the external conductor contact element 6, the internal conductor contact elements 3, the insulating part 12, the insulating protective element 9 as well as a protective cap 24, can finally be pushed onto the internal conductors 4 of the cable 2.

Figure 16:
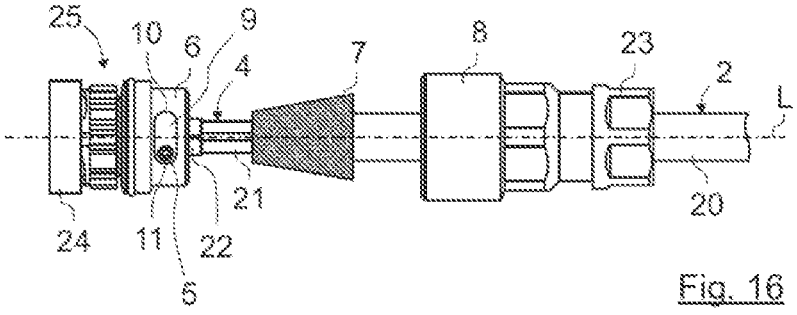
FIG. 16 shows a second method step of an assembly method for a plug-in connector according to the invention.

In a subsequent method step according to FIG. 16, the insulating protective element 9 can initially be moved to the assembly position (if not already preassembled in this way) for the purpose of fastening the internal conductor contact elements 3 to the internal conductors 4 of the cable 2. Therefore, the assembly access point M to the internal conductor contact elements 3 through the external conductor contact element 6 and the insulating part 12 is ensured. For example, a screwdriver 15, illustrated in FIG. 5, can then be used in order to tighten the respective screws 5 for the purpose of clamping the internal conductors 4 in the internal conductor contact elements 3.

Figure 17:
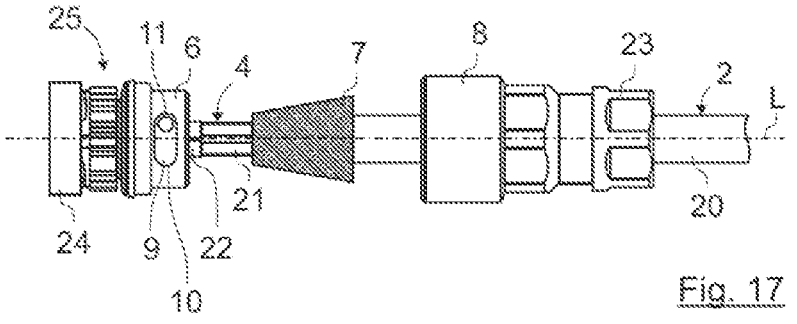
FIG. 17 shows a third method step of an assembly method for a plug-in connector according to the invention.

In a subsequent method step according to FIG. 17, the screwdriver 15, a finger of the fitter or a guide means 16, which may be present, of the insulating protective element 9 can then be used in order to displace the insulating protective element 9 into its insulating protection position in which the assembly access point M to the internal conductor contact element 3 is blocked by the insulating protective element.

Figure 18:
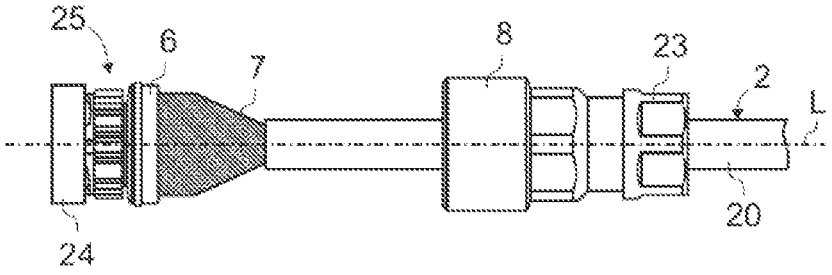
FIG. 18 shows a fourth method step of an assembly method for a plug-in connector according to the invention.

In a subsequent method step according to FIG. 18, provision can be made for the external conductor shielding braid 7 to be placed onto the external conductor contact element 6 of the plug-in connector 1.

Figure 19:
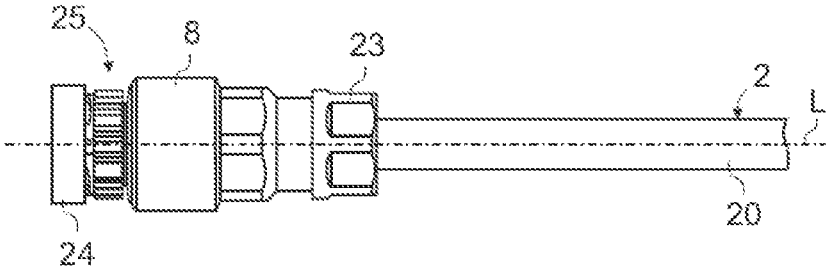
FIG. 19 shows a fifth method step of an assembly method for a plug-in connector according to the invention.

In a further method step, as shown in FIG. 19, the external housing 8 of the plug-in connector 1, together with the lock nut 23, can then be pushed onto the external conductor contact element 6 from behind and screwed to it. As a result, the external conductor shielding braid 7 is firmly clamped between the external conductor contact element 6 and the external housing 8 of the plug-in connector 1. Since the insulating protective element 9 is in its insulating protection position, individual wires of the external conductor shielding braid 7 which may be protruding cannot produce a short circuit with the internal conductor contact elements 3.

Provision may be made for the insulating protective element 9 to have an assembly-preventing arrangement (not illustrated) which permits fitting of the external housing 8 of the electrical plug-in connector 1 only when the insulating protective element 9 is in its insulating protection position. For example, a web which projects axially in the direction of the cable 2 can be provided for this purpose, which web, in the assembly position of the insulating protective element 9, blocks mounting of the external housing 8 of the plug-in connector 1 onto the external conductor contact element 6 in an interlocking manner and clears the displacement path for the external housing 8 to the external conductor contact element 6 only in the insulating protection position.

Figure 20:
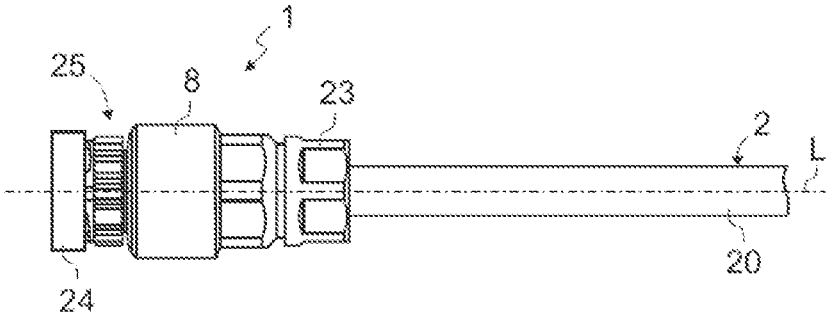
FIG. 20 shows a sixth method step of an assembly method for a plug-in connector according to the invention.

Finally, FIG. 20 illustrates the fully assembled electrical plug-in connector 1 on the cable 2, wherein finally the lock nut 23 has been screwed onto the external housing 8 in order to provide, firstly, leak-tightness between the cable 2 and the plug-in connector 1 and, secondly, strain relief.

While the invention has been described with reference to various preferred embodiments, it should be understood by those skilled in the art that various changes may be made and equivalents substituted for elements thereof without departing from the scope of the invention. In addition, many modifications may be made to adapt to a particular situation or application of the invention without departing from the scope of the invention. Therefore, it is intended that the invention not be limited to the particular embodiments disclosed but rather, that the invention will include all embodiments falling within the scope of the appended claims, either literally or under the Doctrine of Equivalents.

What is claimed is:

1. An electrical plug-in connector for use with an electrical cable of the type having at least one internal conductor, said plug-in connector, comprising:

an internal conductor contact element;

an external conductor contact element, and an insulating protective element between the internal conductor contact element and the external conductor contact element, the external conductor contact element having an assembly recess which provides an assembly access point for fastening the internal conductor contact element to an internal conductor of the electrical cable, the insulating protective element being displaceable between an assembly position and an insulating protecting position, the assembly position being a position in which the assembly access point is cleared through the assembly recess to the internal conductor contact element, the insulating protection position being a position in which the assembly access point to the internal conductor contact element is blocked by the insulating protective element.

2. An electrical plug-in connector as claimed in claim 1, wherein the insulating protective element has an access opening which, in the assembly position, is oriented in relation to the assembly recess such that the assembly access point to the internal conductor contact element is cleared through the assembly recess and the access opening.

3. An electrical plug-in connector as claimed in claim 1, further comprising an insulating part between the internal conductor contact element and the external conductor contact element, the insulating part having an assembly opening which, together with the assembly recess of the external conductor contact element provides the assembly access point.

4. An electrical plug-in connector as claimed in claim 3, wherein the external conductor contact element, the internal conductor contact element, the insulating part and the insulating protective element each have a substantially round cross section.

5. An electrical plug-in connector as claimed in claim 3, wherein the insulating protective element is guided in a groove present in one or more of: (i) the external conductor contact element, (ii) the internal conductor contact element, and (iii) the insulating part.

6. An electrical plug-in connector as claimed in claim 1, wherein one or more of: (i) the assembly recess of the external conductor contact element, (ii) the access opening of the insulating protective element and (iii) the assembly opening of the insulating part comprises a bore or an elongate hole.

7. An electrical plug-in connector as claimed in claim 1, wherein the internal conductor of the cable is fastened to the internal conductor contact element by a screw, and wherein the screw can be operated by inserting a tool into the assembly access point.

8. An electrical plug-in connector as claimed in claim 7, wherein the screw is completely covered by the insulating protective element when the insulating protective element is in the insulating protection position.

9. An electrical plug-in connector as claimed in claim 7, wherein the screw has a head having a diameter which is larger than a diameter of the access opening of the insulating protective element.

10. An electrical plug-in connector as claimed in claim 1, wherein the insulating protective element has a latching means for latching with a latching element to latch the insulating protective element in at least one of: the assembly position and the insulating protection position.

11. An electrical plug-in connector as claimed in claim 1, wherein the electrical plug-in connector has a longitudinal axis, and wherein the insulating protective element is displaceable between the assembly position and the insulating protection position by being displaced with respect to the longitudinal axis.

12. An electrical plug-in connector as claimed in claim 1, wherein the insulating protective element has at least one guide means-which protrudes externally of the external conductor contact element to enable displacement of the insulating protective element by a user when the insulating protective element is in an assembled state within the external conductor contact element.

13. An electrical plug-in connector as claimed in claim 5, wherein the groove is between the insulating part and the external conductor contact element.

14. An electrical plug-in connector as claimed in claim 5, wherein the groove is between the insulating part and the internal conductor contact element.

15. An electrical plug-in connector as claimed in claim 14, wherein the groove is between the insulating part and the internal conductor contact element as well as between the insulating part and the external conductor contact element.

16. An electrical plug-in connector as claimed in claim 11, wherein the insulating protective is displaceable between the assembly position and the insulating protection position by being displaced axially with respect to the longitudinal axis.

17. An electrical plug-in connector as claimed in claim 11, wherein the insulating protective is displaceable between the assembly position and the insulating protection position by being displaced rotationally with respect to the longitudinal axis.

18. An electrical plug-in connector as claimed in claim 1, wherein the insulating protective element has at least one web which protrudes externally of the external conductor contact element to enable displacement of the insulating protective element by a user when the insulating protective element is in an assembled state within the external conductor contact element.

19. A method for assembling an electrical plug-in connector, said method comprising the steps of:

a) displacing the insulating protective element of the electrical plug-in connector into an assembly position in which an assembly access point to an internal conductor contact element of the electrical plug-in connector is cleared through an assembly recess which is provided in an external conductor contact element of the electrical plug-in connector;

b) fastening the internal conductor contact element to an internal conductor of an electrical cable through the assembly access point when the insulating protective element is in the assembly position; and c) displacing the insulating protective element into an insulating protection position in which the assembly access point to the internal conductor contact element is blocked by the insulating protective element.

20. An electrical plug-in connector for use with an electrical cable of the type having at least one internal conductor, said plug-in connector, comprising:

an internal conductor contact element;

an external conductor contact element, and an insulating protective element between the internal conductor contact element and the external conductor contact element, the insulating protective element being displaceable between an assembly position and an insulating protecting position, the assembly position being a position in which an assembly access point is clear to permit fastening the internal conductor contact element to an internal conductor of the electrical cable, the insulating protection position being a position in which the assembly access point to the internal conductor contact element is blocked by the insulating protective element.

* * * * *